US007377116B2

(12) United States Patent
Parker et al.

(10) Patent No.: US 7,377,116 B2
(45) Date of Patent: May 27, 2008

(54) GAS TURBINE COMBUSTOR BARRIER STRUCTURES FOR SPRING CLIPS

(75) Inventors: David Marchant Parker, Oviedo, FL (US); Kristian I. Wetzl, Orlando, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 32 days.

(21) Appl. No.: 11/117,051

(22) Filed: Apr. 28, 2005

(65) Prior Publication Data

US 2006/0242964 A1 Nov. 2, 2006

(51) Int. Cl.
*F23R 3/60* (2006.01)

(52) U.S. Cl. ..... 60/796; 60/752; 60/800

(58) Field of Classification Search ..... 60/39.091, 60/39.092, 752, 796, 798, 800
See application file for complete search history.

(56) References Cited

U.S. PATENT DOCUMENTS

| | | | | |
|---|---|---|---|---|
| 2,494,659 | A * | 1/1950 | Huyton | 285/41 |
| 2,592,060 | A | 4/1952 | Oulianoff | |
| 3,702,058 | A | 11/1972 | De Corso et al. | |
| 3,759,038 | A | 9/1973 | Scalzo et al. | |
| 4,413,470 | A | 11/1983 | Scheihing et al. | |
| 4,719,748 | A | 1/1988 | Davis, Jr. et al. | |
| 5,987,879 | A | 11/1999 | Ono | |
| 6,732,528 | B2 | 5/2004 | Akagi et al. | |
| 6,869,082 | B2 * | 3/2005 | Parker | 277/630 |

FOREIGN PATENT DOCUMENTS

| | | |
|---|---|---|
| CH | 256078 | 7/1948 |
| JP | 58102031 A | 6/1983 |
| JP | 61173024 A | 8/1986 |
| JP | 07332113 A | 12/1995 |

* cited by examiner

*Primary Examiner*—L. J. Casaregola

(57) ABSTRACT

A barrier structure (302) blocks exit of spring clip fragments (317) that may break off from a spring clip assembly disposed between a gas turbine engine combustor (300) and a transition piece component (360). The barrier structure (302) may additionally comprise an aspect (326) effective to restrict a spring clip's (310, 311) radially inward compression, thereby reducing or eliminating damage to the spring clip (310, 311) during shipping and handling. The barrier structure (302) additionally may comprise an aspect (330) to restrict access by a human hand to the free ends (318) of the spring clips (310, 311). This aspect (330) reduces or eliminates the undesired lifting of the compressor by grabbing the spring clips (310, 311) during combustor transport, installation or removal. Accordingly, barrier structure embodiments are provided that reduce stress on spring clips, and that prevent the exit of spring clips from a containment space partly formed by the barrier structure.

17 Claims, 10 Drawing Sheets

GAS TURBINE COMBUSTOR BARRIER STRUCTURES FOR SPRING CLIPS

BACKGROUND OF THE INVENTION

A modern gas turbine engine, such as is used for generation of electricity at power plants, is a multi-part assembly of sub-components, many of which are subjected to vibrational and thermal stresses over long periods of operation. To the extent that various sub-components and their respective parts are designed, manufactured, shipped and installed to reduce undesired stresses, this may result in longer operation and less downtime.

In common configurations of gas turbine engines, a plurality of combustors is arranged radially. Compressed air flows through these combustors, including through, in each such basket, one or more fuel/air mixing devices (such as swirler assemblies), and then through a combustion zone. The combustion zone begins after a barrier, such as a base plate, that demarcates an upstream end of the combustion zone. The combustion zone may terminate before or may extend into what is referred to as a "transition piece" (alternatively referred to as a "tail pipe," "transition duct," or "combustion tube" by some in the field, partly depending on the elements upstream to this). The transition piece is a conduit that carries hot gases into a turbine where the gases effectuate movement of turbine blades and thereby turn a rotor, such as to generate electricity.

A common approach to assembly of a transition piece with a combustor in a gas turbine engine is to attach at a downstream end (in terms of operation and direction of gas flow) of the combustor an assembly of spring clips. U.S. Pat. No. 4,413,470 (the '470 patent), issued Nov. 8, 1983 to Scheihing and Laurelli, describes a spring clip ring assembly at a downstream end of a combustor that provides sliding support that accommodates thermal growth by a catalytic unit. A second spring clip ring is used to establish a relationship between a catalytic unit and a transition piece. FIGS. 11-15 of the '470 patent depict, and the associated text describes, spring clip assemblies, or rings, that respectively each comprises a plurality of spring fingers (referred to as spring clips herein). This patent is incorporated by reference for its teachings of spring clips and their assembly in a combustor. In addition, this and all other patents, patent applications, patent publications, and other publications referenced herein are hereby incorporated by reference in this application in order to more fully describe the state of the art to which the present invention pertains, to provide such teachings as are generally known to those skilled in the art.

Further as to combustors and their operation, the general operation of main swirler assemblies and pilots are known in the art of can-annular gas turbine engine combustion and operation. For example, aspects of this technology are described in U.S. Pat. No. 6,732,528, issued May 11, 2004 to Akagi and Tomimoto. Also, aspects of the functioning of a transition piece (and, depending on the reference, to other aspects of a gas turbine engine) are disclosed in the following U.S. Pat. No. 4,719,748, issued Jan. 19, 1988 to Davis et al.; U.S. Pat. No. 4,903,477, issued Feb. 27, 1990 to Butt; U.S. Pat. No. 6,463,742, issued Oct. 15, 2002 to Mandai et al.; and U.S. Pat. No. 5,906,093, issued May 25, 1999 to Coslow and Whidden.

As one example of combustor structure, FIG. 1A provides a side partial cut-away view of a particular prior art combustor 100 of a gas turbine engine with an upstream end 102, a downstream end 104, and an assembly 108 of spring clips

112 affixed to the downstream end 104. A plate 114 at the upstream end 102 provides a structure for attachment of the combustor 100 to another structural member (not shown) of the gas turbine engine. Bracing ribs 116 are attached to the plate 114 and extend downstream along the exterior of the combustor 100. Also viewable in FIG. 1A through the cut-away section is a central pilot 120 about which a plurality of main swirler assemblies (e.g. six or eight, not viewable in FIG. 1A) is arranged.

FIG. 1B provides a side view of the encircled area of FIG. 1A, providing more details of the assembly 108 of spring clips 112. The non-compressed state of the most forward-shown spring clips 112 is exhibited by showing distance 'a,' and spaces 109 are shown between adjacent spring clips 112. Location 115 identifies one of a plurality of spot welds of the spring clips 112 to an outer frame 118 of combustor 100. The spot welds extend circumferentially around the combustor 100. Also, it is observable that the assembly 108 is comprised of an inner layer 110 and an outer layer 111 of spring clips 112.

FIG. 1C provides an upstream end view of the assembly 108 of spring clips 112 further showing the inner layer 110 and the outer layer 111. These layers 110 and 111 are shown without other components, and are shown offset to one another, so that the spaces 109 are not aligned. This offset arrangement of the spaces 109 reduces passage of gases during operation.

FIG. 1D provides a side partial cut-away view of the prior art combustor 100 of FIG. 1A joined in operational position with a prior art transition piece 150. The transition piece has an upstream end 152, and a downstream end 154 that connects to an entrance of a turbine (not shown). The upstream end 152 has a circumferentially extending transition inlet ring 156 which is disposed over the assembly 108 of spring clips 112. FIG. 1E provides an enlarged view of the area encircled in FIG. 1D, to better show aspects of and the relationships between the spring clips 112 and the transition inlet ring 156.

Further referring to FIG. 1E, the transition inlet ring 156 compresses spring clips 112, as evidenced by a distance 'b' that is smaller than uncompressed distance 'a' of FIG. 1B. That is, the inside diameter of transition inlet ring 156 is less than the outside diameter of the uncompressed spring clips 112 as depicted in FIG. 1A. This compression aids in achieving a desired tightness of fit at this junction during operation, when there is vibration from combustion and other forces, as well as high temperature from combustion gases.

Having recognized the causes of certain problems associated with the spring clips, such as those described above, the present inventors have conceived solutions that address one or more problems related to shipping, installation, repair and operational incidents pertaining to these springs on a gas turbine engine combustor.

DETAILED DESCRIPTION OF EMBODIMENTS OF THE INVENTION

Figure 1A:
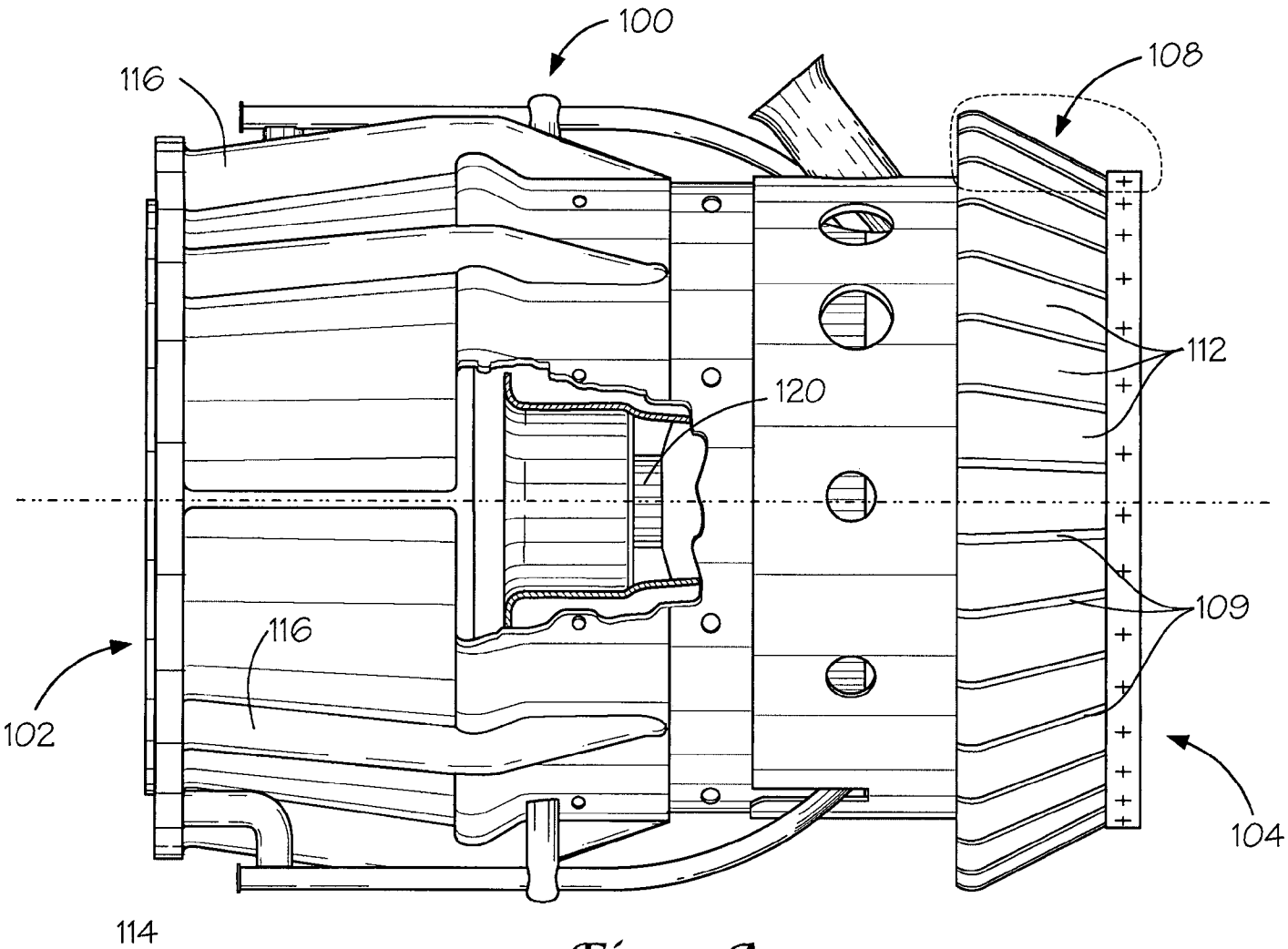
Fig. 1A (Prior Art)
FIG. 1A is a side partial cut-away view of a particular prior art combustor.
Figure 1B:
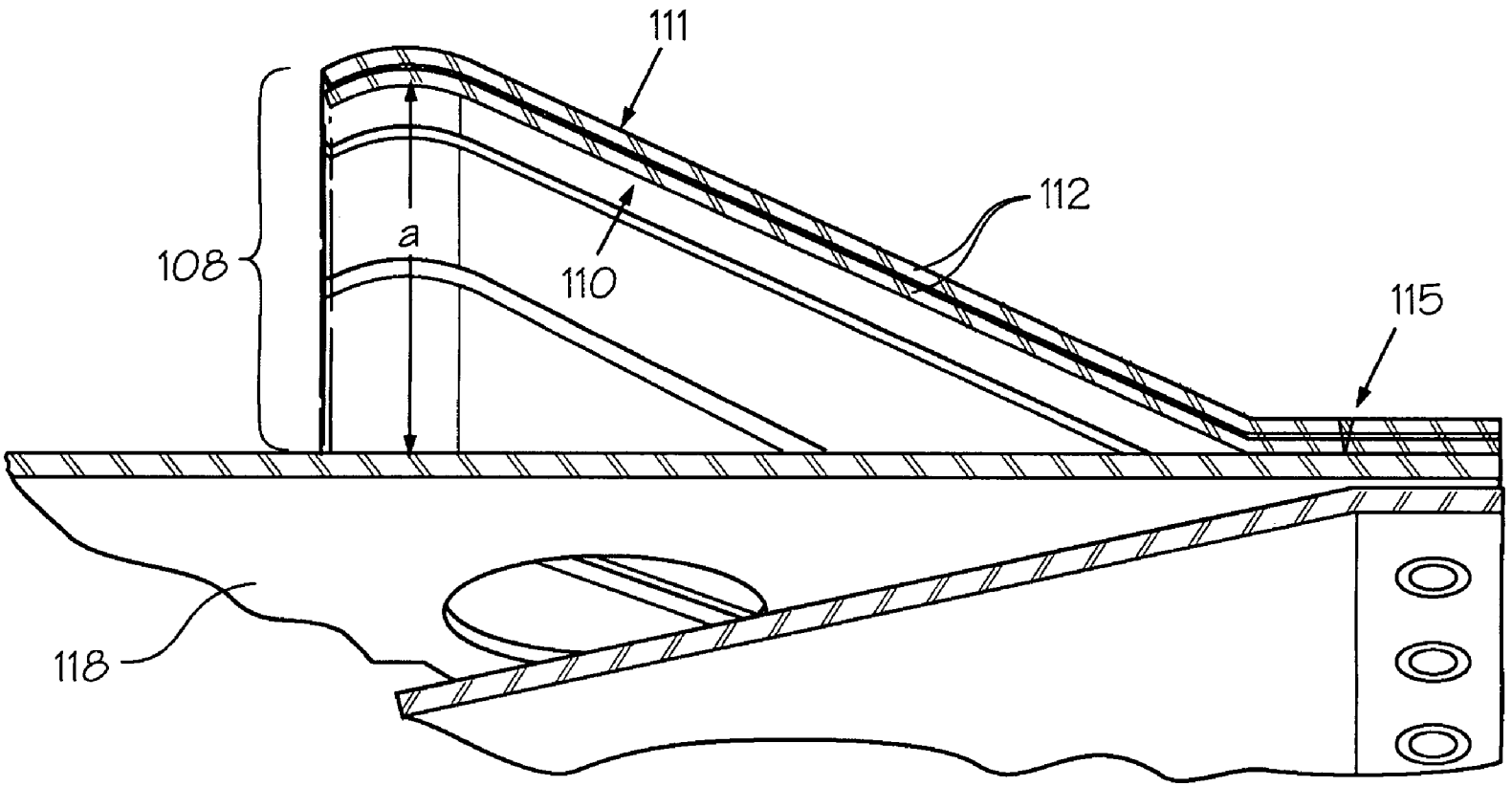
Fig. 1B (Prior Art)
FIG. 1B provides a cross-section view of the encircled area of FIG. 1A, taken along the A-A axis of FIG. 1A.
Figure 1C:
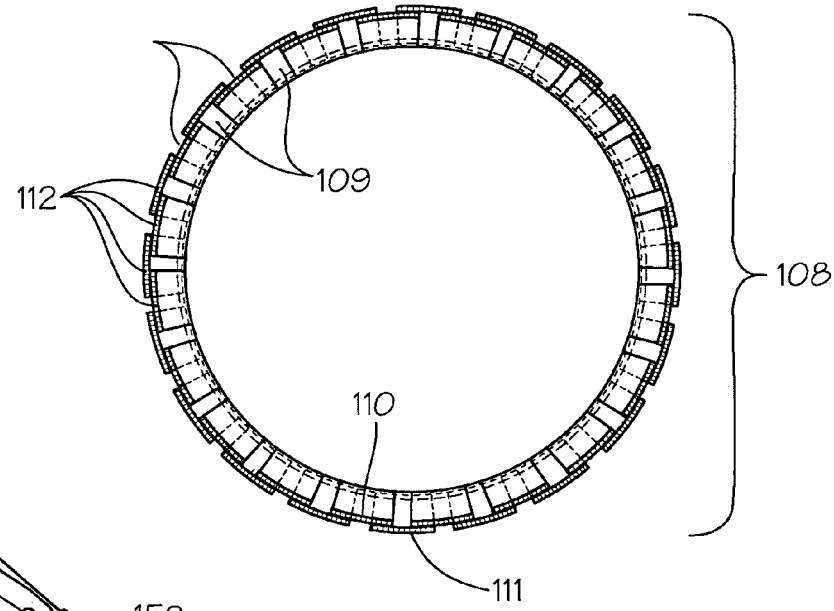
Fig. 1C (Prior Art)
FIG. 1C provides an end view of two offset concentric arrangements of spring clips.

The present inventors have identified problems regarding the functionality and durability of present designs of spring clips for the junction between a combustor and a transition piece. The present inventors have identified that stresses placed on spring clips during shipping and/or installation/removal procedures may result in later spring clip breakage during turbine operation, and that a broken off spring clip fragment may cause damage and/or unscheduled down time. Through such identification of multiple problems, and their interrelationship, the present inventors have conceived of and developed solutions that provide a containment-type barrier structure that is protective of spring clip assemblies disposed between a gas turbine combustor and a transition. Various embodiments may provide multiple protective functions. These embodiments take into account the fact that a combustor and an associated transition piece are subject to move relative to one another during normal gas turbine engine operations.

First, if a spring clip breaks off during operation, it may cause any of a number of problems, some of which result in a forced outage. For example, not to be limiting, a spring clip broken off during operation may become lodged in an air intake of a main swirler assembly. This could disrupt the airflow entering the combustor. The disruption in airflow can result in a combustor flashback condition and subsequent combustor and fuel nozzle damage. This in turn would force an unscheduled outage for repairs. A spring clip fragment traveling in the air flow path may also cause other damage to the gas turbine engine.

Second, it has been appreciated that during shipping and/or installation one or more spring clips may become over-stretched, such as by inward compression toward the outer frame of the combustion basket. Such undesired impacts may result in permanent deformation. Once a spring clip is so deformed, it is highly susceptible to failure. This may lead to failure and breakage of a spring clip, resulting in a free spring clip fragment which may then, if not for the present invention, escape and create problems such as discussed immediately above.

Also, as a third point, it is noted that in some embodiments, by developing a solution to avoid the loss of a spring clip fragment from a defined containment space for the spring clips, a barrier structure also may prevent damage to springs during installation, removal, and repairs. For example, embodiments of the present invention may prevent damage such as may occur when a worker would, but for the invention, place his or her hand under the spring clips to lift or otherwise move the combustor. Alternatively, embodiments of the present invention may prevent damage such as may otherwise occur when, while moving a combustor by a crane or other lift device during installation or removal, an object against which the combustor slides would, if not for the embodiment, catch on the spring clips and deform them. Thus, embodiments of the present invention are effective to reduce or eliminate outward deformation of spring clips during installation, removal and repair operations.

Thus, the present invention is directed to a barrier structure for those spring clips that has at least one of multiple protective functions. For example, a barrier structure generally is associated with a combustor of a gas turbine engine, where a downstream end of the combustor comprises a circumferential assembly of spring clips that slide into and engage the upstream end of a transition piece. When so positioned in a gas turbine engine, the barrier structure creates a tortuous path (such as in combination with an opposing structure) that restricts the escape of a spring clip fragment from a containment space defined by the barrier structure, a portion of the transition piece, and a portion of the exterior of the combustor beneath the spring clips. By so creating a tortuous path, the barrier structure prevents the exit of spring clip fragments from the containment space, thereby retaining the spring clip fragments in the containment space. In other embodiments, the present invention is comprised of a barrier structure affixed to the outer surface of a combustor, the barrier structure sized so that on positioning to that outer surface it achieves this function, of preventing movement of spring clip fragments out of the containment space partly defined by the barrier structure, and also functions to do one or both of the following: 1) restricts inward movement of the spring clips; and 2) restricts access to and handling of the spring clips during installation, removal and repairs. These additional functions are effective to reduce or eliminate damage to spring clips, such as due to inward or outward deformation, during installation, removal and repairs of gas turbine combustors.

For example, the present invention may be comprised of a combustor comprising a barrier structure attached to it that restricts inward movement of springs during shipment. This is believed to reduce the occurrence of damage and/or deformation of spring clips during shipment, thereby reducing the failure rate of spring clips and possible consequent down time of gas turbine engines due to various related failures. In various embodiments the barrier structures also prevent handling of the spring clips that would result in outward stretching. Also, in some embodiments, the present invention is a gas turbine engine comprising at least one combustor comprising a barrier structure attached to it, and having any of the functional features, or combinations of functional features, described herein.

Figure 2A:
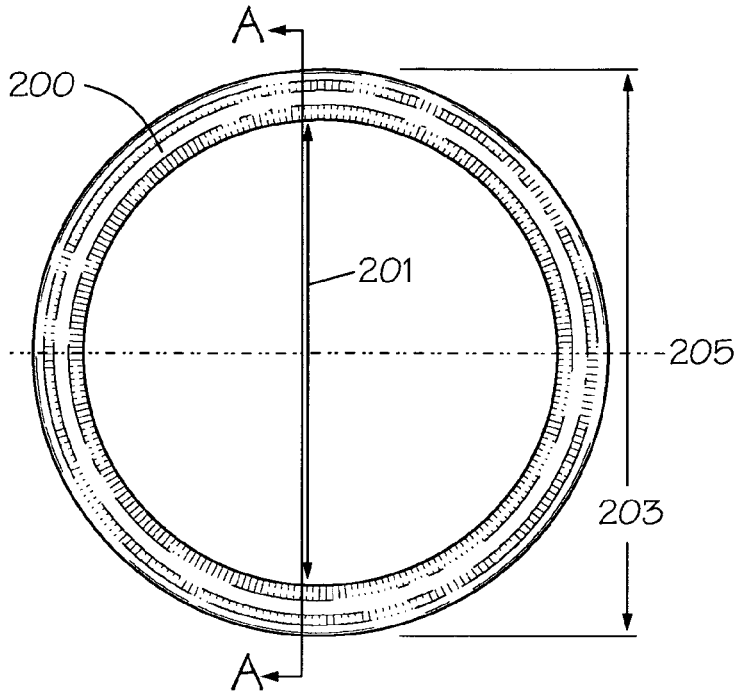
FIGS. 2A-2C provide plan, cross-section, and magnified views, respectively, of a barrier structure of the present invention.
Figure 2B:
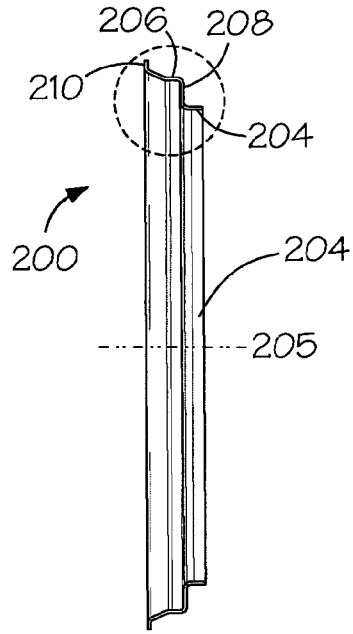
Figure 2C:
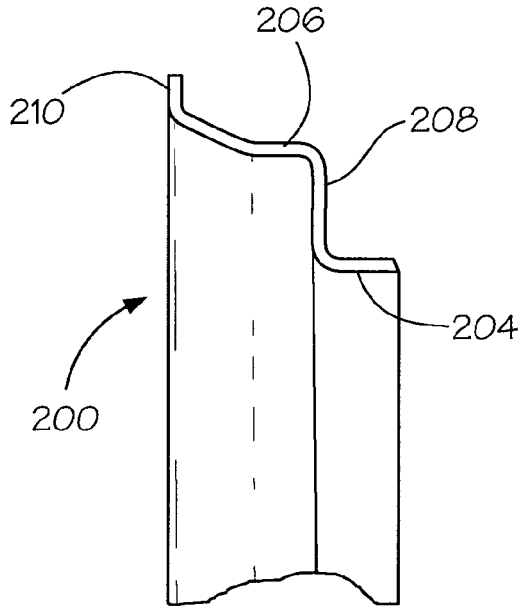

Without being limiting, FIGS. 2A-2C provide plan, cross-section, and magnified views, respectively, of one embodiment of a ring-shaped barrier structure 200 of the present invention. In various embodiments of the present invention, this ring-shaped barrier structure 200 is combined with a combustion basket, with a combustion basket in operational relationship with a transition piece, and as a component of a gas turbine engine.

As shown in FIG. 2A, the barrier structure 200 is ring-shaped and has an inside diameter 201 and an outside diameter 203. The inside diameter 201 is sized so that the barrier structure 200 slidingly engages over an outer surface of a combustor outer frame (not shown in FIG. 2A), to which it is then attached in a proper location (described below regarding FIG. 3B). FIG. 2B depicts a cross-section view of the ring 200 of FIG. 2A taken along line A-A. A cylindrical attachment region 204 having inside diameter 201 is the part of the barrier structure 200 that slidingly engages over a combustor outer frame. An elevated contact surface 206 is joined with the attachment region 204 by an intermediate riser wall 208. Thereafter, moving upstream (noting that the arrow points downstream) the surface of the ring slopes outward to a substantially vertically oriented retention barrier 210 (being substantially vertical relative to a horizontal axis 205 of a combustor over which the barrier structure 200 fits). These features of the barrier structure 200 are more clearly observable in FIG. 2C, which is a detailed enlargement of the encircled area of FIG. 2B.

More generally, it is appreciated that as the retention barrier 210 extends more radially outward, it is increasingly effective to restrict access by a human hand to the spring clips. This, as noted above, is a feature that may prevent damage to the spring clips during installation and removal of the combustor because such restriction to access prevents radially outward manipulation of the spring clips during combustor installation and removal. Such outward manipulation may occur when there is no, or an insufficiently outwardly extending, retention barrier and a worker grabs and lifts the combustor by the thereby exposed spring clips, stressing them outwardly and causing apparent or hidden (e.g., latent stress) damage. Damage may also occur during installation, removal and repair of combustors when a crane or other lift device is moving the combustor and it slides against an object that would, but for an embodiment of the present invention, catch beneath the spring clips and cause outward deformation.

Figure 3A:
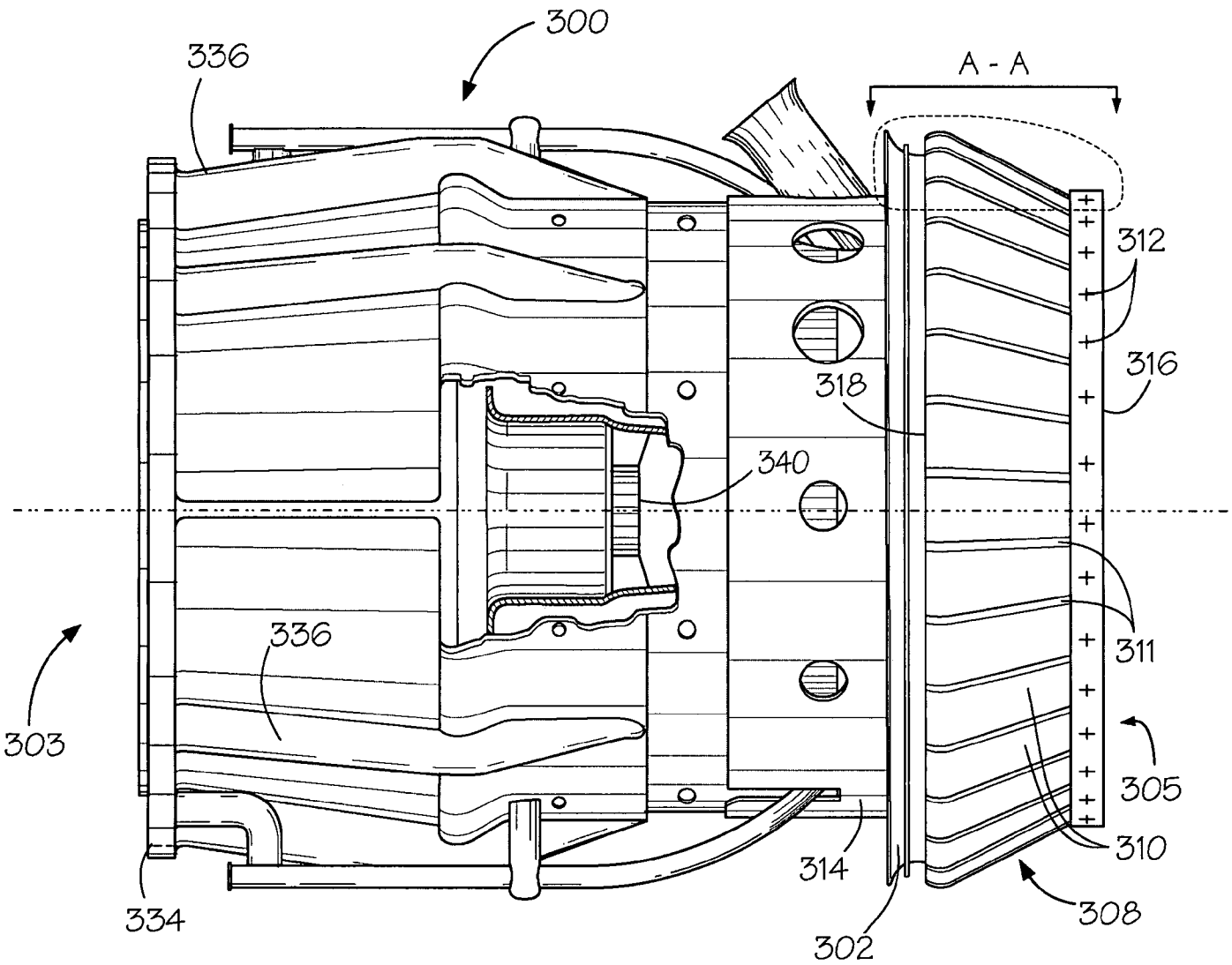
FIG. 3A provides a side partial cut-away view of a combustor with a barrier structure.

FIG. 3A provides a side partial cut-away view of a combustor 300 having attached thereto a barrier structure 302. The combustor 300 has an upstream end 303 and a downstream end 305. An assembly 308 of spring clips 310, each spring clip 310 having a first attached end 316 and a second free end 318, is affixed to the downstream end 305 by spot welding. Being near downstream end 305, the area over which the spring clips 310 are arranged is a downstream portion of the external surface (identified by 315) of combustor 300. Locations of spot welds 312 also are shown as "+" marks at the first attached ends 316 of the spring clips 310 where these are spot welded to an outer frame 314 of combustor 300. The external surface 315 of the outer frame 314 defines the external surface of the combustor 300. Adjacent spring clips 310 are separated by spaces 311. As for the components shown in the combustor 100 of FIG. 1A, combustor 200 also comprises a plate 334 at the upstream end 303 that provides a structure for attachment of the combustor 300 to another structural member (not shown) of the gas turbine engine. Bracing ribs 336 are attached to the plate 334 and extend downstream along the exterior of the combustor 300. Also viewable in FIG. 3A through the cut-away section is a central pilot 340 around which a plurality of main swirler assemblies (e.g. six or eight, not viewable in FIG. 3A) is arranged.

Figure 3B:
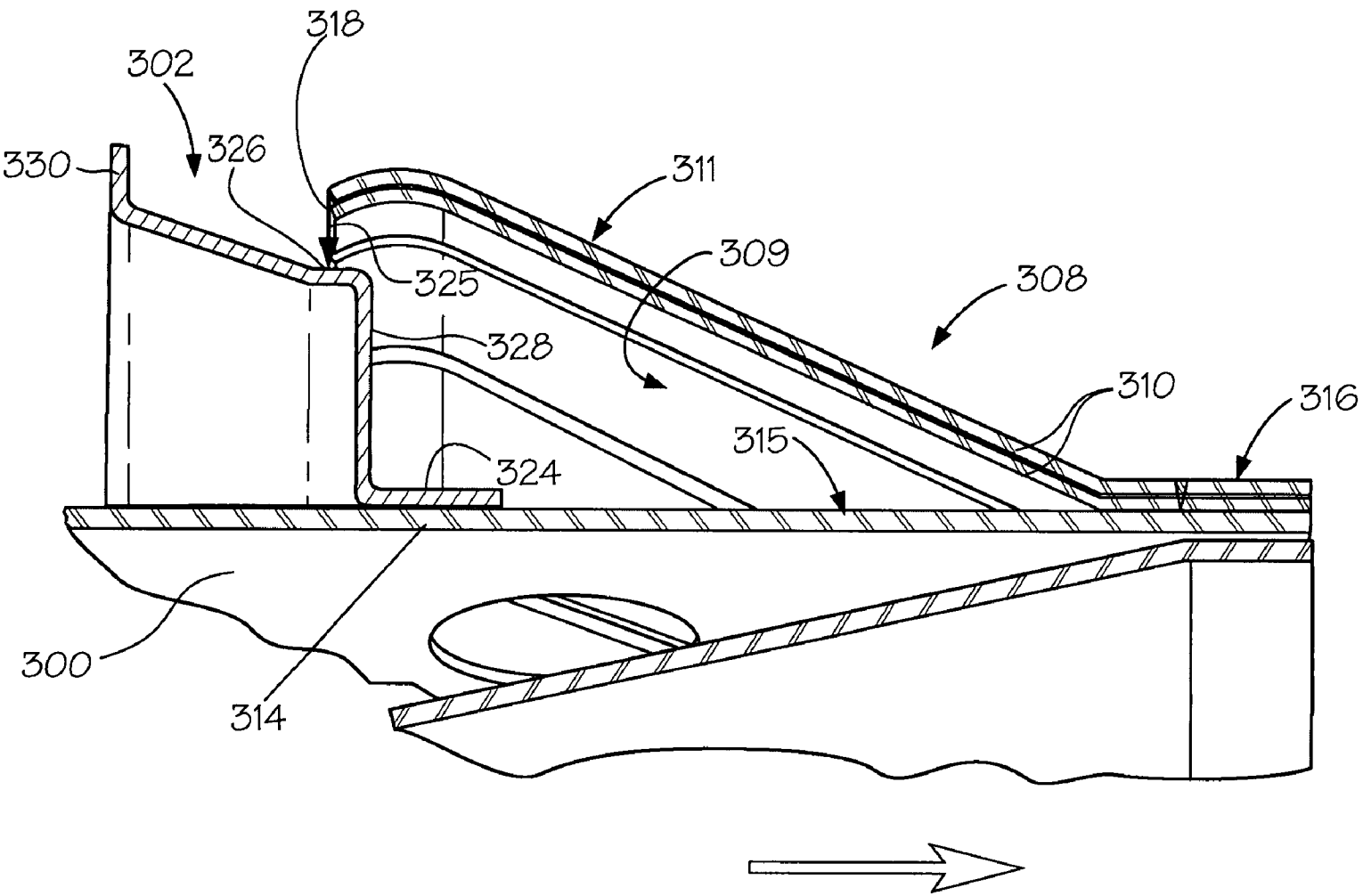
FIG. 3B provides a cross-section view of the encircled area of FIG. 3A taken along the A-A axis of FIG. 3A.

FIG. 3B provides a cross-section view of the encircled area of FIG. 3A taken along the A-A axis of FIG. 3A, providing more details of the assembly 308 of spring clips 310, particularly in relation to the barrier structure 302. Each spring clip 310 has a first attached end 316 and a second free end 318, and the assembly 308 is comprised of an inner layer 309 and an outer layer 311 of spring clips 310. Each respective spring clip comprises an interior side, facing the outer frame 314, and an opposing exterior, or exposed side. In the embodiment depicted in FIG. 3B, the barrier structure 302 comprises an attachment region 324 that slidingly engages over the outer frame 314. An elevated contact surface 326 connects with the attachment region 324 by an intermediate riser wall 328. Thereafter, moving upstream (noting that the arrow points downstream) the surface of the ring 302 slopes outwardly to a substantially vertically oriented retention barrier 330. These components possess characteristics and relationships as described for the barrier structure 200 of FIGS. 2A-2C.

With the barrier structure 302 so positioned on the combustor 300, the inward movement (i.e., designated by arrow 325, toward the center of combustor 300) of each spring clip 310 (whether in an inner layer 309 or an outer layer 311) is restricted by a portion of the adjacent elevated contact surface 326. This restricts the spring clips 310 from experiencing a permanent deformation or stress, such as during an unintended shipping impact.

Figure 3C:
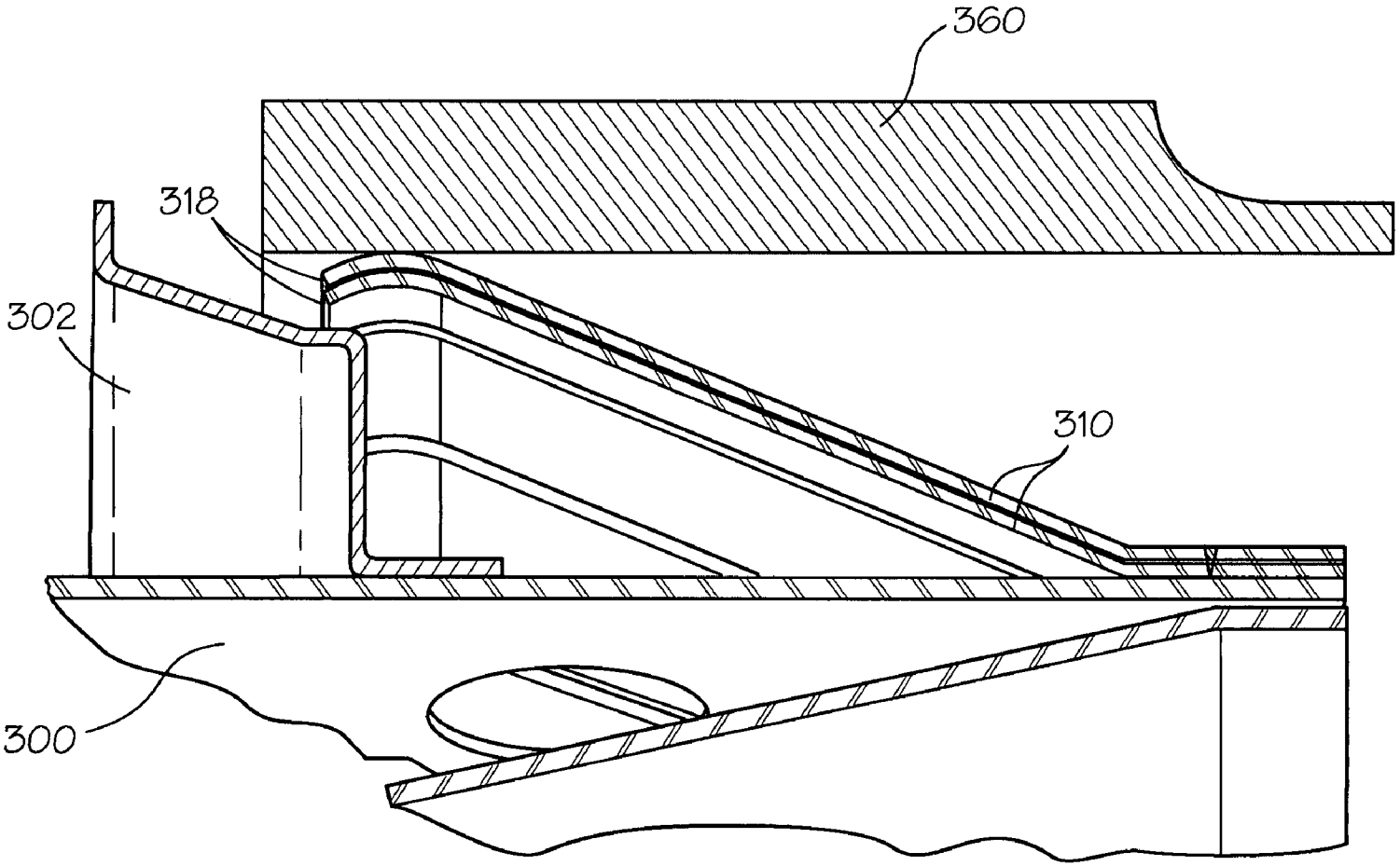
FIG. 3C provides a cross-section view of the encircled area of FIG. 3A taken along the A-A axis of FIG. 3A, however additionally depicting the cross-section of a transition ring inlet in operational position with respect to the combustor of FIG. 3A.

FIG. 3C provides a cross-section view of the encircled area of FIG. 3A taken along the A-A axis of FIG. 3A, however additionally depicting the cross-section of a transition ring inlet 360 in operational position with respect to the combustor 300 of FIG. 3A. As noted in the discussion related to FIG. 1E, a transition ring inlet (such as 360) is positioned along an upstream end of a transition piece (not shown in FIG. 3C, but see FIG. 1D). Due to the smaller inside diameter of transition ring inlet 360 compared to the diameter of the unrestrained free end 318 of spring clips 310 (see FIG. 3B), the spring clips 310 as shown in FIG. 3C are compressed by transition inlet ring 360. As noted in the discussion of FIG. 1E, such compression aids in achieving a desired tightness of fit at this junction during operation, when there is vibration from combustion and other forces, as well as high temperature from combustion gases.

When as depicted in FIG. 3C the combustor 300 comprising the barrier structure 302 and is so positioned in the transition ring inlet 360, the positional relationship of certain points are effective to restrict the release, or exit, of a spring clip fragment. As used herein, including the claims, a "spring clip fragment" is taken to mean a portion at least one of the spring clips of an assembly of such spring clips, such as disposed along the downstream end of a combustor, that is produced by a breaking off of a portion of a spring clip. It has been observed that nearly always a spring clip fragment breaks at or near the attachment area of the spring clip (i.e., at attachment ends such as shown as 316 in FIG. 3A). Breakage at such area results in a spring clip fragment having a length nearly the full length (from upstream to downstream end) of the originally installed spring clip. That is, these spring clip fragments generally have a length at least 75 percent of the full length of the respective spring clip from which they were formed.

It also is appreciated that a spring clip fragment may be defined in terms of a "predetermined size spring clip fragment", which refers to a spring clip fragment having an specified maximum distance from one point or edge to a most distant point or edge of the broken-off spring clip fragment. Based on the curvature and other geometry (e.g., width) of a particular spring clip fragment, embodiments of the present invention are designed to prevent the passage of a predetermined size spring clip fragment through the upstream end of a space partly defined by a barrier structure of the present invention. However, even taking into consideration of a relative difference between the ease of exit through a given tortuous path by a 'thin' or a relatively 'thicker' spring clip fragment having the same overall length, a predetermined size spring clip fragment may have, for example, a length of at least about 50 percent, or, alternatively, at least about 75 percent, of the full length of a spring clip from which it was formed.

Figure 1D:
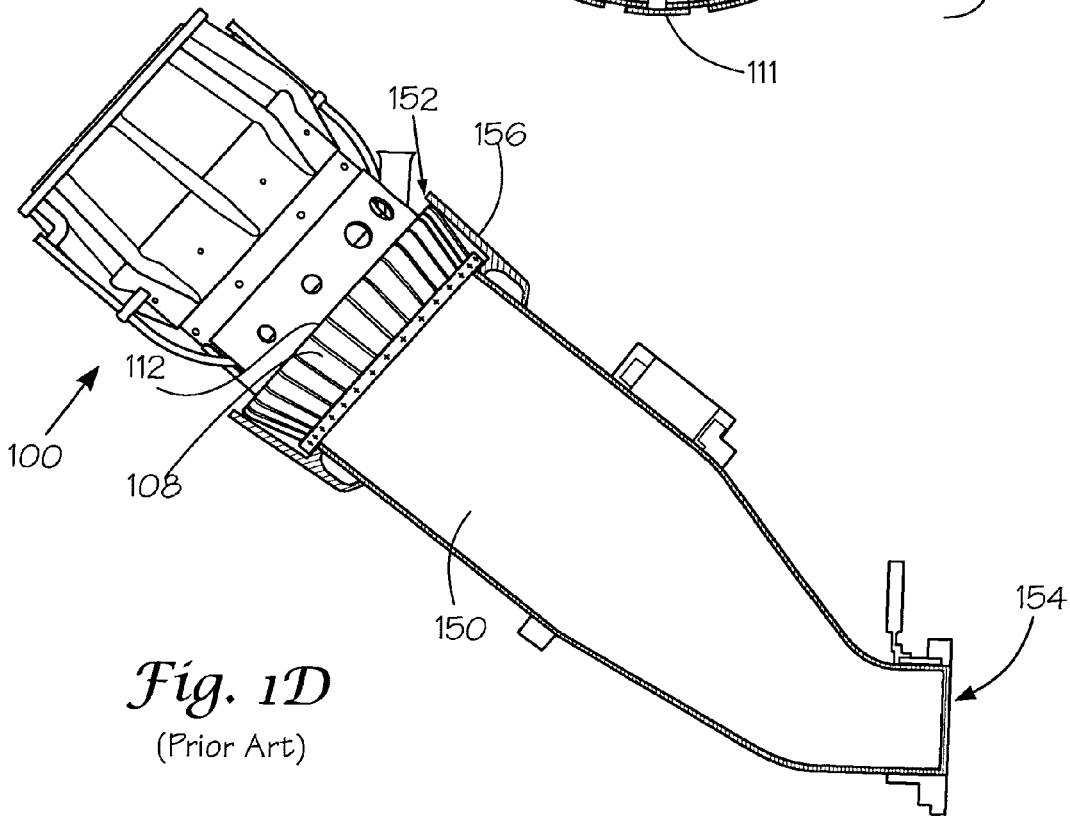
Fig. 1D (Prior Art)
FIG. 1D provides a side partial cut-away view of the combustor of FIG. 1A joined in operational position with a prior art transition piece.
Figure 1E:
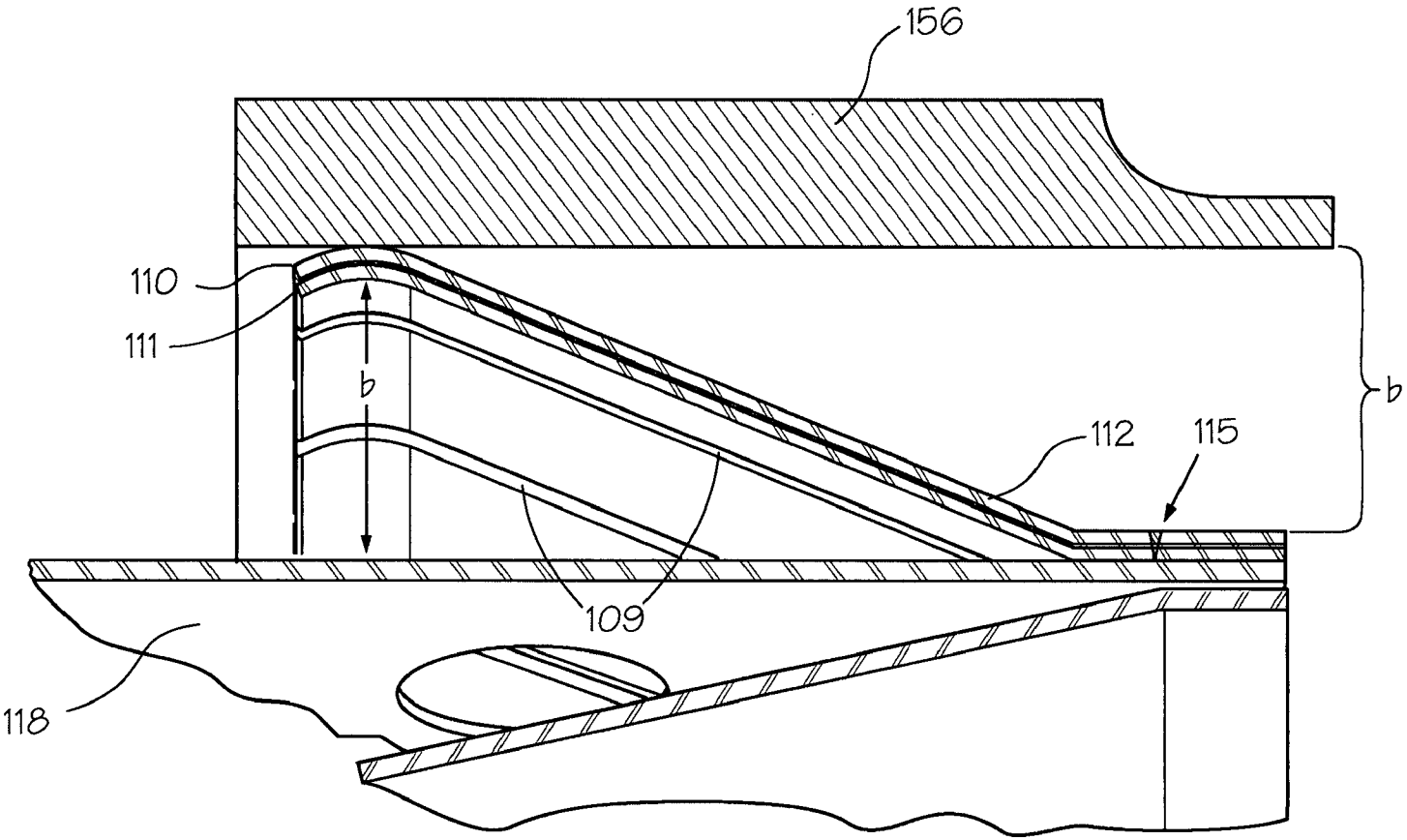
Fig. 1E (Prior Art)
FIG. 1E provides an enlarged view of the area encircled in FIG. 1D.
Figure 3D:
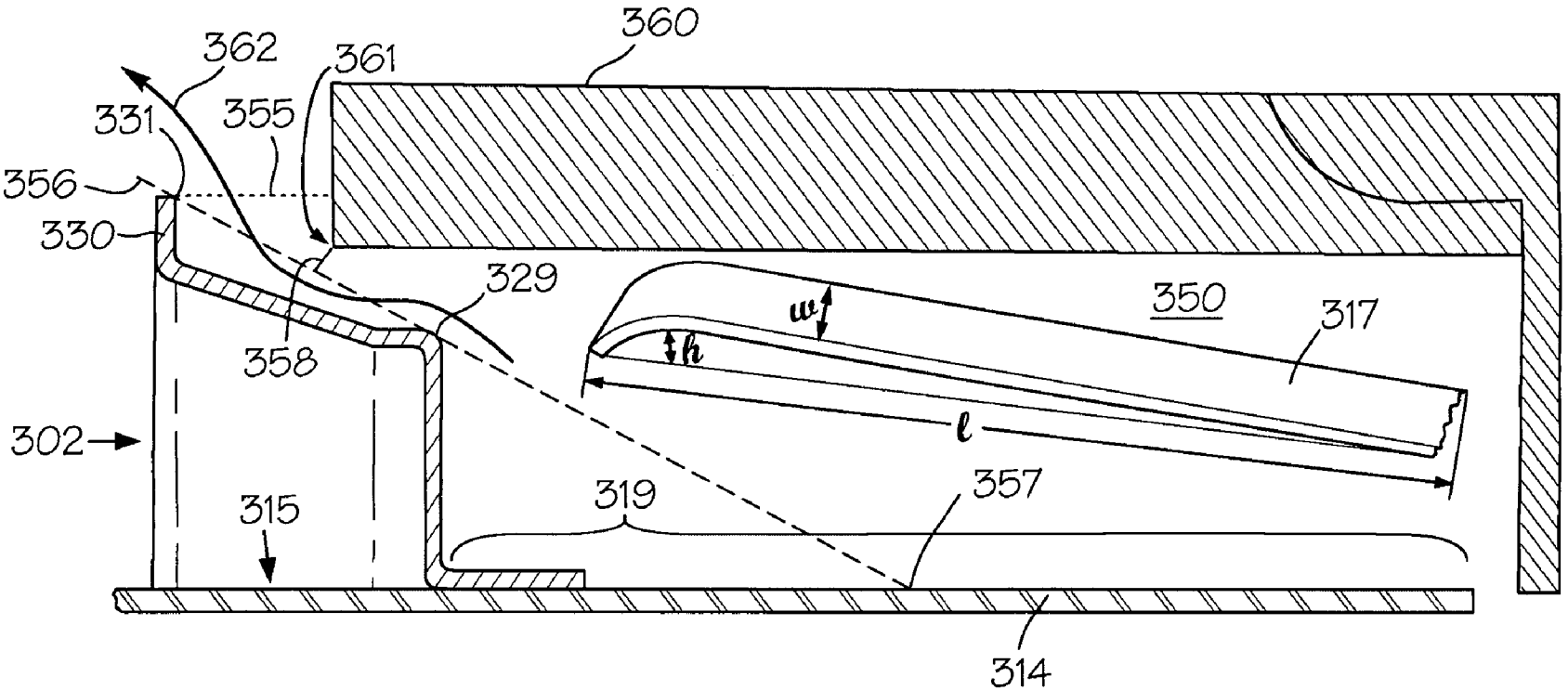
FIG. 3D is a cross-section view similar to FIG. 3C but in which only one spring clip fragment, in perspective view, is depicted.

FIG. 3D is a cross-section view that provides an example of this in a depiction similar to FIG. 3C but in which only one spring clip fragment 317 is shown. A containment space 350 is defined interiorly by a portion 319 of the external surface 315 of the combustor outer frame 314, exteriorly and downstream by the transition inlet ring 360, and upstream by the barrier structure 302, with a gap 355 identified by a dotted line. This gap 355 generally represents an opening (i.e., a possible exit) from the containment space 350, and is partly defined by the positioning of the barrier structure 302 across an upstream exit end of the containment space 350 which may be annular and is formed between the combustor outlet and the transition inlet. It is noted that while not depicted in FIG. 3C, the transition inlet ring 360 or other components of the transition form a downstream section that helps define the containment space 350 (i.e., see FIG. 1D for one example of the joining of a transition inlet ring to other component of the transition). The arrangements shown in FIGS. 1D and 3D are not meant to be limiting. Also, it is appreciated that the barrier structure 302 effectively blocks an upstream-oriented exit end of the containment space, leaving only a smaller passage, the gap 355, as a possible avenue for exit of a spring clip fragment. It is further appreciated that a gap such as gap 355 is needed to accommodate movements of a transition (not shown in FIG. 3D) in relation to a combustor (i.e., see FIG. 1D).

Further to FIG. 3D, spring clip fragment 317 has a length 'l,' a width 'w,' and a height 'h'. The length 'l' is defined as the distance between two points of the spring clip fragment 317 that are spaced farthest apart on a linear line. A dashed line 356 connects a first barrier edge 331, defined by the outer edge of retention barrier 330, and a second barrier edge 329, and extends down to a point 357 on the outer surface of combustor outer frame 314. Transition inlet ring 360 has an interior corner 361, and the distance between the dashed line 356 and corner 361 is identified as distance 358.

Thus, the components as shown in FIG. 3D form a tortuous path (identified as 362) by virtue of distance 358 and the arrangement of points 331 and 329, through which spring clip fragment 317, having a predetermined size relative to such tortuous path 362, cannot pass. That is, as to the identified tortuous path 362, this presents an exit path sufficiently restrictive so as to prevent a predetermined portion of a spring clip from passage. As to the height 'h' of spring clip fragment 317, it is noted that although shown as a specific distance, it is appreciated that the wider is the spring clip fragment 317, given the curved nature of the components forming the tortuous path 362, a particular wider but shorter spring clip fragment may still not pass through a restrictive path such as tortuous path 362.

More generally, it is appreciated that a barrier structure of the present invention need not have the elements arranged as shown in the figures above, and need not have the dimensional relationships and interrelationships of these elements as shown in the figures above. For example, not to be limiting, the surface from an elevated contact surface (such as 326 of FIG. 3B) to a retention barrier (such as 330 of FIG. 3B) need not slope outwardly. Instead, an elevated contact surface may extend linearly and concentrically, in relation to the surface of the combustor) to meet the retention barrier. Also, without being limiting, the attachment region need not be cylindrical (but instead may match the contour of a particular combustor), and may be arranged in a different relationship to the elevated contact surface (such as directly inward to it, instead of downstream and radially inward), or to the retention barrier (such as disposed upstream of it, as when an elevated contact surface is not provided, or is cantilevered without direct support of the attachment region).

Further, a tortuous path, such as that shown in FIG. 3D, may be formed by an arrangement of elements other than those shown in that figure. The elements whose edges or corners contribute to forming a tortuous path may be arranged in an interdigitating fashion, or may be otherwise arranged so as to be effective to restrict passage of a spring clip fragment having a predetermined dimension. For example, it is appreciated that although three points helping to define a tortuous path in FIG. 3D (i.e., 329, 330 and 361) are not interdigitating. Given the size of the representative spring clip fragment 317, this path nonetheless is sufficiently restrictive and is tortuous with respect to such a spring clip fragment. It is noted that for a given length of a spring clip fragment, the surface of the combustor (i.e., 314 of FIG. 3D) also contributes to defining a restrictive path.

Also, it is appreciated that the spring clips that are disposed between the combustor outlet end and the transition inlet end need not be attached to the combustor. That is, they may be attached to the transition inlet and appropriately oriented, such as to permit sliding engagement with the combustor as it enters and retains a position. Alternatively, spring clips may be positioned in the containment space, which is partly defined by a barrier structure as defined and described herein, without fixed attachment to either the transition or the combustor. In such embodiments the barrier structure helps form the containment space in which the spring clips are maintained.

Figure 4:
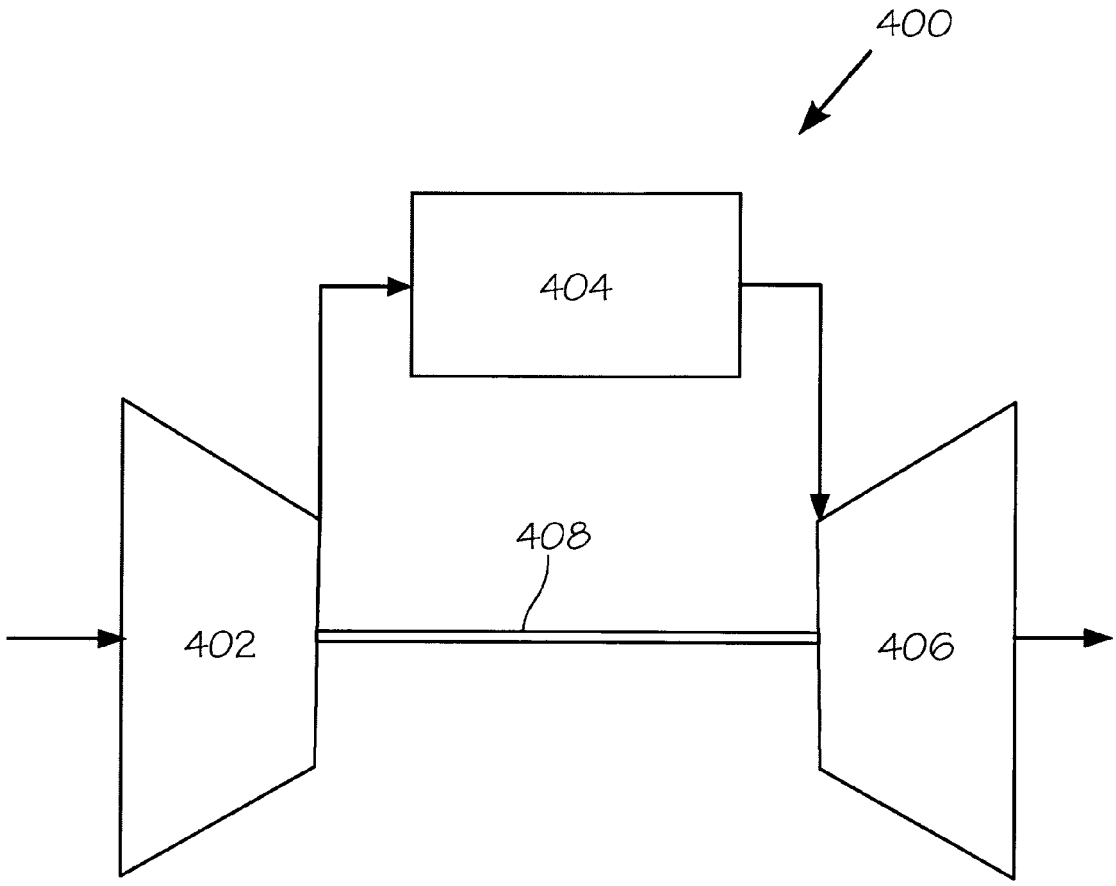
FIG. 4 is a schematic depiction of a gas turbine engine in which various embodiments of the present invention may be utilized.

Finally, FIG. 4 provides a schematic depiction of a gas turbine engine 400 comprising a compressor 402, a combustor 404 (such as a can-annular combustor), and a turbine 406 connected by shaft 408 to compressor 402. During operation, compressor 402 provides compressed air to a combustor 404, which mixes the air with fuel (as described above), providing combusted gases to a turbine 406, which may generate electricity and which also turns compressor 402 by shaft 408. It is appreciated that a gas turbine engine 400 as shown in FIG. 4 may comprise embodiments of the respective barrier structure in combination with the combustor and transition as described herein.

Accordingly, many modifications and other embodiments of the invention will come to the mind of one skilled in the art having the benefit of the teachings presented in the foregoing descriptions, the associated drawings, and the additional disclosures. Therefore, it is to be understood that the invention is not to be limited to the specific embodiments disclosed, and that other modifications and embodiments are intended to be included within the spirit and purview of this application and the scope of the appended claims.

What is claimed is:

1. A combustor of a gas turbine engine, comprising an external surface and a plurality of spring clips disposed externally and circumferentially along a downstream portion of the external surface to contact an upstream end of a transition piece into which the combustor is engaged, further comprising a barrier structure positioned to form a containment space surrounding the spring clips and defined by the barrier structure, the transition piece, and the downstream portion, the barrier structure adapted to form a tortuous path adjacent an upstream opening from the containment space, whereby an entire spring clip, or a fragment thereof of a predetermined size, cannot exit the upstream opening through the tortuous path and is thereby retained in the containment space.

2. The combustor of claim 1 wherein the barrier structure additionally comprises an elevated contact surface adapted to make contact with a respective spring clip upon radially inward compression of the spring clip, to limit the radially inward compression of the spring clip.

3. The combustor of claim 2, wherein the barrier structure comprises an annular shape, a cylindrical attachment region having an inside diameter sized to slidingly engage over the external surface, the elevated contact surface, and an outwardly oriented retention barrier disposed upstream of the elevated contact surface.

4. The combustor of claim 3, wherein the radially outwardly oriented retention barrier has an elevation effective to restrict access to interior sides of the spring clips, whereby such access restriction prevents radially outward manipulation of the spring clips during combustor installation and removal.

5. The combustor of claim 1, wherein the barrier structure is additionally adapted to restrict access to interior sides of the spring clips, whereby such access restriction prevents radially outward manipulation of the spring clips during combustor installation and removal.

6. The combustor of claim 5, wherein the barrier structure comprises an annular shape and comprises a cylindrical attachment region having an inside diameter sized to slidingly engage over the external surface, an elevated contact surface adapted to restrict radially inward movement of a respective spring clip, and a substantially radially outwardly oriented retention barrier, disposed upstream of the elevated contact surface and providing said access restriction.

7. The combustor of claim 5, wherein the access restriction is effective to restrict access by a human hand.

8. The combustor of claim 1, wherein said tortuous path is effective to retain in the containment space a spring clip fragment comprising an entire spring clip except for an attachment area at which a weld connects the entire spring clip to the external surface.

9. The combustor of claim 1, wherein said tortuous path is effective to retain in the containment space a predetermined size spring clip fragment having a length at least about 50 percent of the length of an entire spring clip from which the fragment was formed.

10. The combustor of claim 1, wherein said tortuous path is effective to retain in the containment space a predetermined size spring clip fragment having a length at least about 75 percent of the length of an entire spring clip from which the fragment was formed.

11. A combustor of a gas turbine engine having an external surface, comprising a plurality of spring clips disposed externally and circumferentially along a downstream portion of the external surface to contact an upstream end of a transition piece into which the combustor is engaged, and a barrier structure positioned in relation to the spring clips and the transition piece to form a containment space defined by the barrier structure, the transition piece, and the portion, the barrier structure comprising a generally circular shape and comprising a cylindrical attachment region having an inside diameter sized to slidingly engage over the external surface, an annular elevated contact surface adapted to restrict radially inward movement of a respective spring clip, and a substantially radially outwardly oriented retention barrier, disposed upstream of the elevated contact surface and effective to restrict access to interior sides of the spring clips, the barrier structure adapted to create a tortuous path adjacent an opening from the containment space, whereby a spring clip fragment cannot pass through the tortuous path to the opening and is thereby retained in the containment space.

12. A gas turbine engine comprising a compressor, a combustor comprising an external surface and an inlet and an outlet, the combustor outlet adapted to engage an inlet of a transition, and a gas turbine in fluid communication with an outlet of the transition, the combustor outlet and the transition inlet overlappingly disposed to define an annular space therebetween, a spring clip disposed in the annular space, and a barrier structure restricting an exit end of the annular space whereby an entire spring clip, or a fragment thereof of a predetermined size, cannot pass from the annular space, wherein the barrier structure is ring-shaped and comprises a cylindrical attachment region having an inside diameter sized to slidingly engage over the external surface, an annular elevated contact surface adapted to restrict radially inward movement of a respective spring clip, and a substantially radially outwardly oriented retention barrier, disposed upstream of the elevated contact surface, effective to restrict access by a human hand to interior sides of the respective spring clips.

13. The combustor of claim 12, wherein the barrier structure is additionally adapted to restrict access to interior sides of the respective spring clips, whereby such access restriction prevents radially outward manipulation of the spring clips during combustor installation and removal.

14. The combustor of claim 12, wherein said tortuous path is effective to retain in the containment space a predetermined size spring clip fragment having a length at least about 50 percent of the length of an entire spring clip from which the fragment was formed.

15. The combustor of claim 12, wherein said tortuous path is effective to retain in the containment space a predetermined size spring clip fragment having a length at least about 75 percent of the length of an entire spring clip from which the fragment was formed.

16. A gas turbine engine comprising a compressor, a combustor comprising an external surface and an inlet and an outlet, the combustor outlet adapted to engage an inlet of a transition, and a gas turbine in fluid communication with an outlet of the transition, the combustor outlet and the transition inlet overlappingly disposed to define an annular space therebetween, a spring clip disposed in the annular space, and a barrier structure restricting an exit end of the annular space whereby an entire spring clip, or a fragment thereof of a predetermined size, cannot pass from the annular space, wherein the barrier structure additionally comprises an elevated contact surface adapted to make contact with a respective spring clip upon radially inward compression of the spring clip, to limit the radially inward compression of the spring clip, and wherein the barrier structure comprises an annular shape, a cylindrical attachment region having an inside diameter sized to slidingly engage over the external surface, the elevated contact surface, and an outwardly oriented retention barrier disposed upstream of the elevated contact surface.

17. The combustor of claim 16 wherein the radially outwardly oriented retention barrier has an elevation effective to restrict access to the interior sides of the spring clips, whereby such access restriction prevents radially outward manipulation of the spring clips during combustor installation and removal.

* * * * *